United States Patent [19]

Sando et al.

[11] 4,339,856

[45] Jul. 20, 1982

[54] APPARATUS FOR CONTINUOUS UNTWISTING AND CRIMPING OF A CLOTH

[75] Inventors: Yoshikazu Sando; Hiroshi Ishidoshiro; Matsuo Minakata, all of Wakayama, Japan

[73] Assignee: Sando Iron Works Co., Ltd., Wakayama, Japan

[21] Appl. No.: 150,063

[22] Filed: May 15, 1980

[30] Foreign Application Priority Data

| | | | |
|---|---|---|---|
| May 16, 1979 | [JP] | Japan | 54-64986[U] |
| Jun. 1, 1979 | [JP] | Japan | 54-74401[U] |
| Jul. 11, 1979 | [JP] | Japan | 54-95176[U] |
| Aug. 24, 1979 | [JP] | Japan | 54-116521[U] |
| Aug. 30, 1979 | [JP] | Japan | 54-119590[U] |

[51] Int. Cl.[3] ..... D06C 29/00

[52] U.S. Cl. ..... 28/155; 26/18.5; 68/205 R

[58] Field of Search ..... 26/18.5; 68/205 R; 28/155

[56] References Cited

U.S. PATENT DOCUMENTS

| | | | |
|---|---|---|---|
| 3,007,223 | 11/1961 | Wehrmann | 26/18.6 |
| 3,195,210 | 7/1965 | Wehrmann | 26/18.6 |
| 3,205,686 | 9/1965 | Norton | 68/205 R X |
| 3,579,679 | 5/1971 | Willis | 26/18.5 UX |
| 3,757,548 | 9/1973 | Collinge | 26/18.5 X |
| 3,827,262 | 8/1974 | Manuch | 68/205 R X |
| 3,978,696 | 9/1976 | Ito et al. | 26/28.5 X |
| 4,087,993 | 5/1978 | Sando et al. | 68/205 R X |

FOREIGN PATENT DOCUMENTS

| | | | |
|---|---|---|---|
| 506798 | 7/1952 | Belgium | 26/18.5 |
| 612768 | 8/1926 | France | 68/205 R |
| 2285485 | 4/1976 | France | 26/18.5 |

*Primary Examiner*—Robert Mackey

*Attorney, Agent, or Firm*—Toren, McGeady & Stanger

[57] ABSTRACT

An apparatus for continuous untwisting and crimping of a cloth, including, in a treating chamber, a pair of endless net conveyers spaced vertically apart and forming a gap therebetween to serve as a cloth passage. A plurality of jet pipes, each having a series of nozzles, are arranged to jet a high pressure fluid into the cloth passage. The jet pipes are provided in a zigzag up and down arrangement on the outside of the gap with the net conveyers between them. As a long knitted or woven cloth is passed continuously through the cloth passage while it receives the force of a fluid jetted zigzag from both sides, the cloth adopts a snaky or undulating state, and is stretched, beat and crumpled strongly so that the cloth is untwisted and crimped effectively.

2 Claims, 12 Drawing Figures

APPARATUS FOR CONTINUOUS UNTWISTING AND CRIMPING OF A CLOTH

SUMMARY OF THE INVENTION

The present invention relates to an apparatus for continuous untwisting and crimping of a long cloth by utilizing the jetting force of a fluid.

When a cloth, particularly one strongly twisted, is beat and crumpled repeatedly, the yarns constituting the cloth are untwisted and the cloth is crimped or felted to produce such articles as crepe (crepe de Chine) and georgette. Many apparatuses have been proposed to untwist and crimp a long knitted or woven cloth by applying beating and crumpling forces to a continuously moving cloth, including some by the present applicants. However, since a mechanical force has conventionally been applied to beat and crumple the cloth, the apparatus becomes unavoidably large and complicated. Moreover, many problems occur in its construction and in the durability of the moving parts of the apparatus.

Under such circumstances, the present invention offers a new and excellent apparatus for continuously untwisting and crimping a long cloth by utilizing the jetting force of a fluid, which is simple in its construction and durable, and in which a knitted or woven cloth can conveniently be untwisted and crimped.

The essential point of the present invention comprises providing a pair of endless net conveyers spaced vertically apart and forming a gap therebetween to serve as a cloth passage, and a plurality of jet pipes having a series of nozzles are arranged to jet a high pressure fluid into the cloth passage. The jet pipes are provided in a zigzag arrangement on the outsides of the net conveyers forming the gap. While a cloth is passed through the cloth passage it receives the jetting force of a fluid flowing from the zigzag arrangement of jet pipes with the cloth traveling in a snaky or wavy state, being stretched, beat and crumpled. The yarns constituting the cloth are untwisted and the cloth is crimped effectively. Thus, the present inventive apparatus is very suitable for the continuous untwisting and crimping of a long cloth, and, moreover, the apparatus is simple in its construction and is durable.

In the following, the details of the invention will be explained according to the drawings showing the examples of the apparatus.

DETAILED DESCRIPTION OF THE INVENTION

EXAMPLE 1

Figure 1:
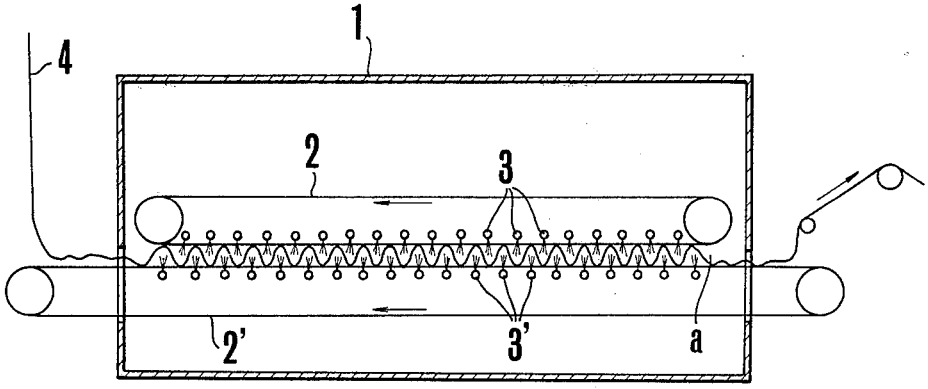
FIG. 1 is a schematic sectional side view of an apparatus embodying the present invention.

In FIG. 1, an example of the present inventive apparatus is shown in the moving direction of the conveyer and the cloth. This example is the basic one in the present invention and is convenient to understand the principle of the invention.

In FIG. 1, a treating chamber 1 contains a pair of horizontally extending endless net conveyers 2,2' provided one above the other in spaced relation forming a gap therebetween to serve as a cloth passage. Net conveyer 2 forms the upper side and net conveyer 2' forms the lower side of the gap a or cloth passage. (Hereinafter, other lower side members will also be denoted with the reference mark '.) The conveyers are permeable for liquid and gas, and rotate in the direction of the arrows shown in the figure. A plurality of jet pipes 3,3', are provided each having a series of nozzles to jet a high pressure fluid onto the cloth. The jet pipes are provided in a zigzag arrangement at equal spacings in the direction along the conveyer or in the direction of the cloth passing through the cloth passage. Some of the jet pipes are located about the lower rim of the upper conveyer 2 and the others below the upper rim of the lower conveyer 2'. A knitted or woven long cloth 4 to be treated is passed through the apparatus.

The process for untwisting and crimping a long cloth continuously by using this apparatus will be explained in the following. The net conveyers 2 and 2' are rotated at an equal and constant speed, and the cloth 4 is transferred through the cloth passage a at a prescribed speed while spraying a high pressure fluid onto the cloth from each of the nozzles attached to the jet pipes 3 and 3'. The high pressure fluid may be any of hot water, cold water, steam and air, and is selected suitably in accordance with the nature of the cloth to be treated. The cloth adopts a snaky state or tortuous form through the cloth passage due to the pressure of the fluid jetted in a zigzag manner from both sides of the cloth passage, while the cloth receives stretching, beating and crumpling forces to produce the untwisting and crimping of the cloth effectively.

The apparatus of this example may be modified in various ways, and particularly, different arrangements of the jet pipes have respectively their own specific effect.

EXAMPLE 2

Figure 2:
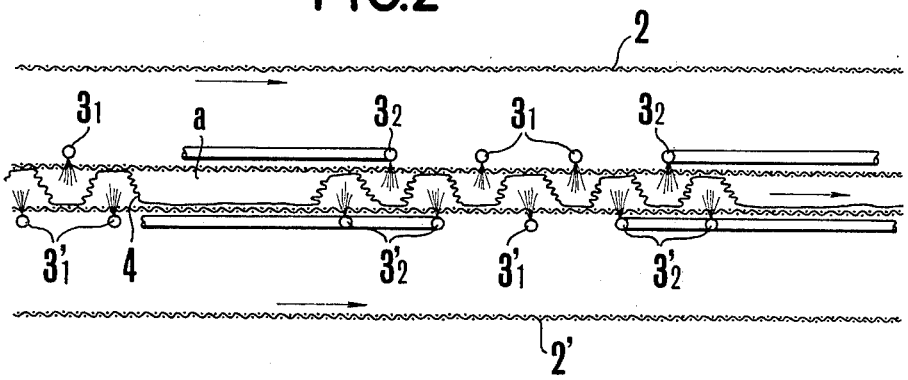
FIG. 2 is an elevational view of another embodiment of the jet pipes illustrated in the apparatus in FIG. 1.
Figure 3:
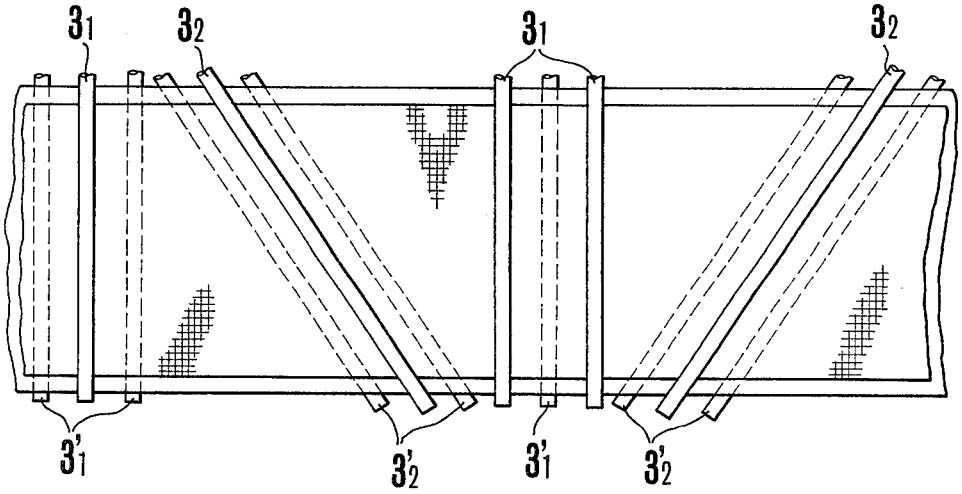
FIG. 3 is a plan view of the jet pipes shown in FIG. 2.

Another example of the present inventive apparatus is shown in FIGS. 2 and 3.

In this example, a plurality of jet pipes are divided, as seen from FIG. 3, into two groups, each comprising a number of jet pipes provided in a zigzag arrangement similar to FIG. 1 with one group, $3_1$ and $3_1'$, being in the perpendicular direction crosswise to the conveyer, and the other group, $3_2$ and $3_2'$, being oblique to the conveyers with definite angles, desirably about 45° and about 135°, and the two groups are arranged alternating with one another at equal intervals.

The condition of the cloth passing through the cloth passage in this example can be seen in FIG. 2. The cloth goes through the cloth passage forming snaky undulations not only in the direction crosswise to the cloth but also in the direction oblique (bias) thereto while receiving stretching, beating and crumpling forces in the said two directions, and particularly, the intersecting points of the warps and wefts constituting the cloth are shifted due to the jetting pressure of the fluid, so that the untwisting and crimping of the cloth can be done more eminently than in Example 1.

EXAMPLE 3

Figure 4:
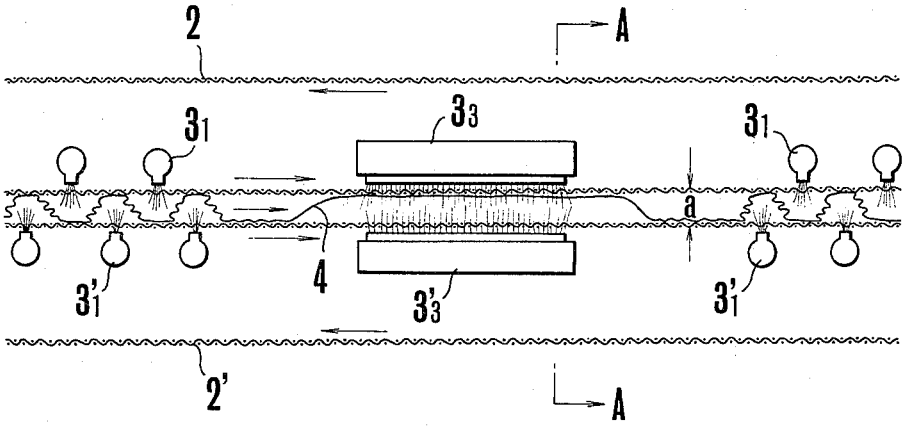
FIG. 4 is a schematic view of another apparatus embodying the present invention.
Figure 5:
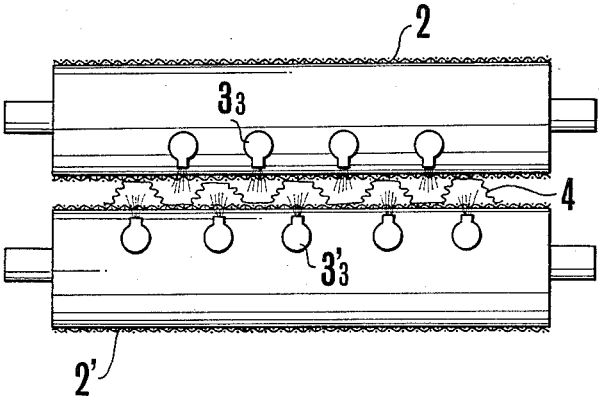
FIG. 5 is a cross-sectional view taken along the line A—A in FIG. 4.
Figure 6:
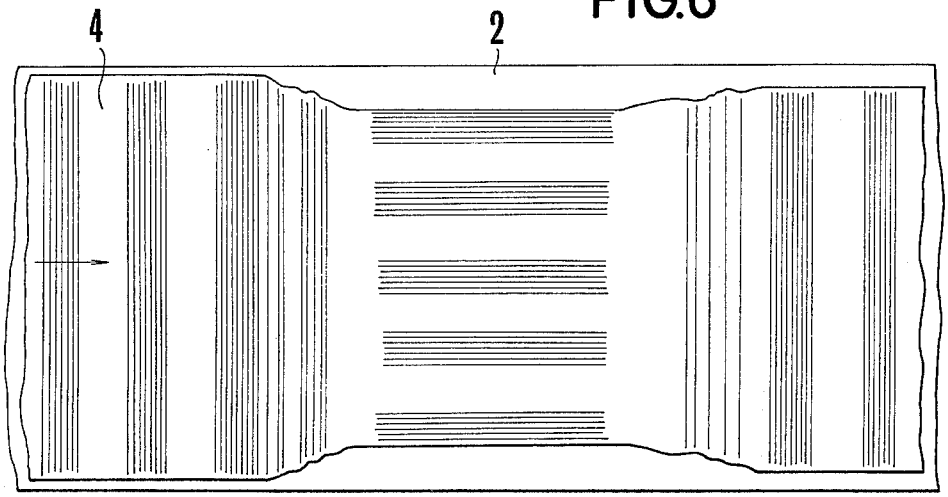
FIG. 6 is a plan view showing the condition of the cloth being passed through the apparatus illustrated in FIGS. 4 and 5.

In this example, as shown in FIGS. 4, 5 and 6 a plurality of jet pipes are divided into two groups, each comprising a number of jet pipes provided in a zigzag up and down arrangement with the pipes being in parallel and at equal spacings. One group extending in the direction crosswise to the conveyers and the other extending in the lengthwise direction of the conveyers, and the two groups are arranged alternating with one another at equal intervals.

Jet pipes $3_1$, $3_1'$ are provided in the direction crosswise to the conveyers, and jet pipes $3_3$, $3_3'$ are provided in the direction lengthwise of the conveyers.

In this example, the jetting force through the jet pipes $3_1$ and $3_1'$, provided in the direction crosswise to the cloth, is particularly effective in untwisting and crimping the warps of the cloth, and the jetting force through the jet pipes $3_3$ and $3_3'$ provided in the direction lengthwise to the cloth is particularly effective in untwisting and crimping the wefts of the cloth. The condition of the cloth under treatment can be seen in FIG. 6. In this way, untwisting and crimping of a cloth is done quite effectively, and particularly, the cloth treated has a suitable elasticity both in the crosswise and the lengthwise directions.

EXAMPLE 4

In untwisting and crimping a long cloth continuously by using the present inventive apparatus, it is desirable to control the width of the cloth passage as well as the distance between the upper and the lower jet pipes. In passing a cloth in a snaky state through the cloth passage, the condition of the cloth differs according to the kinds of the cloth whether the cloth is thin or thick. When the cloth is of thin-make or of weak-kneed, the cloth easily adopts a snaky configuration with a large width through the cloth passage, so that it is desirable to make the width of the cloth passage as large as possible. On the other hand, when the cloth is of thick-make or of strong-kneed, the cloth does not easily adopt a snaky configuration, so that it is necessary to narrow the width of the cloth passage and the distance between the two sets of jet pipes positioned above and below the cloth passage so as to give the cloth a strong jet force. With the use of an apparatus in which the width of the cloth passage and the distance between the upper side and the lower side jet pipes are constant, a satisfactory untwisting and crimping of a cloth can hardly be done in accordance with the nature of the cloth.

This example offers an excellent device for controlling simultaneously both the width of the cloth passage or the gap between the two conveyers and the distance between the two sets of jet pipes. Furthermore, since it is desirable to control the tension applied to the conveyers, this example also offers a convenient device therefor. The devices can also be applied to similar apparatuses for continuously subjecting a cloth to such treatments as drying, wet heat treatment and liquid treatment in general.

Figure 7:
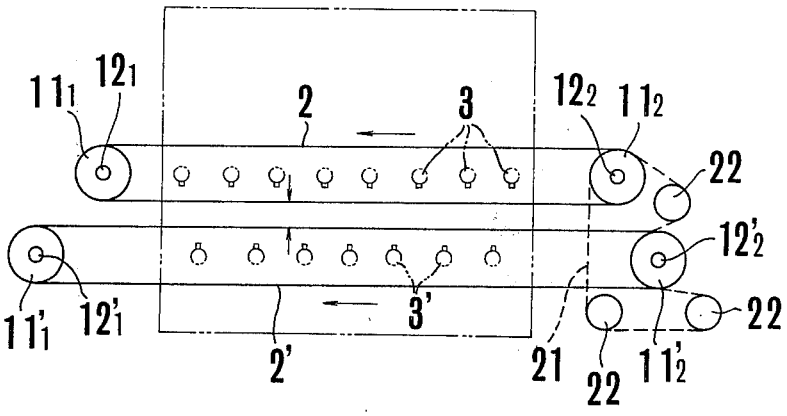
FIG. 7 is a schematic side view of an apparatus embodying the present invention.
Figure 8:
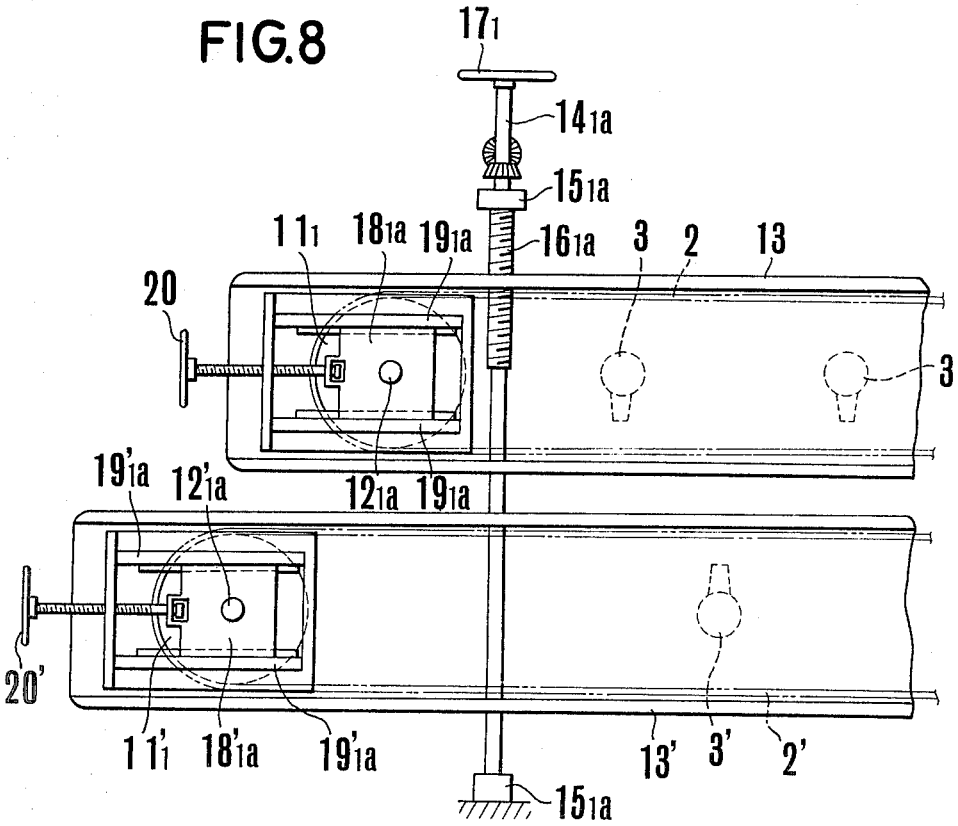
FIG. 8 is a partial enlarged detail view of the apparatus displayed in FIG. 7.
Figure 9:
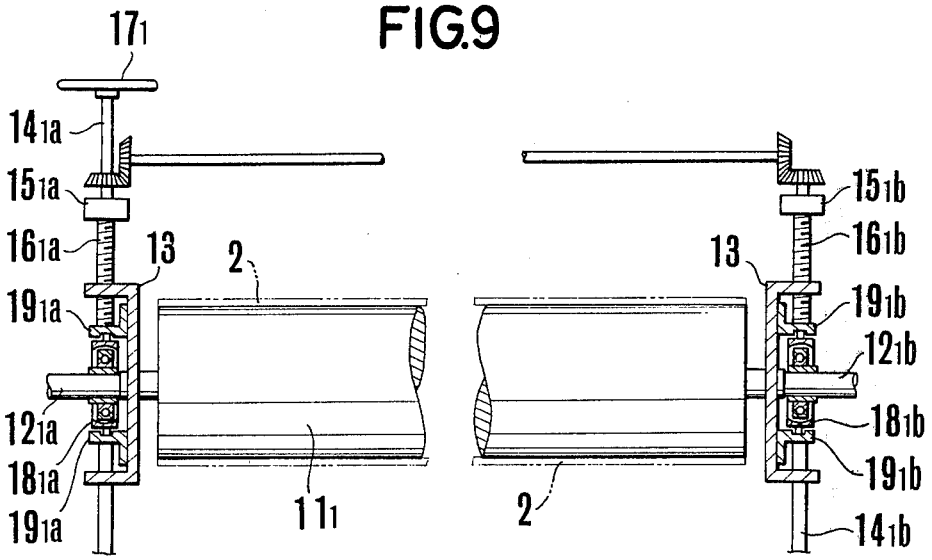
FIG. 9 is a partial transverse view of the apparatus exhibited in FIG. 8.

FIG. 7 shows the general concept of the devices while FIGS. 8 and 9 show essential parts of the apparatus. Although the drawings show the application of the two devices for the apparatus in Example 1, the devices are also applicable to the apparatuses in Examples 2 and 3.

As shown in FIG. 7, the upper conveyer 2 is supported freely rotatable by a pair of guide rollers $\mathbf{11}_1$ and $\mathbf{11}_2$ provided at both ends of the conveyer. Shafts $\mathbf{12}_1$ and $\mathbf{12}_2$ support the two guide rollers. The two guide rollers $\mathbf{11}_1$ and $\mathbf{11}_2$ are supported with the aid of both ends of the support shafts (for instance, $\mathbf{12}_{1a}$ and $\mathbf{12}_{1b}$ for the guide roller $\mathbf{11}_1$) by a common channel-type support plate 13 extending in the moving direction of the conveyer (FIGS. 8 and 9). (The details of the construction will be explained hereinafter.) The upper jet pipes 3 are also attached to the support plate 13. The lower conveyer 2' is supported similarly as is the upper conveyer by a support plate 13', and the lower jet pipes 3' are also attached thereto.

The lower side support plate 13' is fixed to a fixed frame (not shown in the figures). On the other hand, both ends of the upper side support plate 13 are supported respectively by a pair of vertical shafts $\mathbf{14}_{1a}$, $\mathbf{14}_{1b}$ and another pair of vertical shafts $\mathbf{14}_{2a}$, $\mathbf{14}_{2b}$ (not shown in the figures). The shafts $\mathbf{14}_{1a}$ and $\mathbf{14}_{1b}$ are provided freely rotatable with a pair of bearings $\mathbf{15}_{1a}$ and $\mathbf{15}_{1b}$ positioned at both ends of the support shafts $\mathbf{12}_1$, i.e. $\mathbf{12}_{1a}$ and $\mathbf{12}_{1b}$, and with male screws $\mathbf{16}_{1a}$ and $\mathbf{16}_{1b}$ to fit with female screws (not shown in the figures) attached to the support plate 13 (cf. FIG. 9). Therefore, by rotating the vertical shafts $\mathbf{14}_{1a}$ and $\mathbf{14}_{1b}$ by use of a handle $\mathbf{17}_1$, the height of the support plate 13 at this end of the conveyer can freely be controlled. The vertical shafts $\mathbf{14}_{2a}$ and $\mathbf{14}_{2b}$ situated at the other end of the conveyer 2 are supported similarly as in the case of the shaft $\mathbf{14}_{1a}$ and $\mathbf{14}_{1b}$ so as to control the height of the support plate at the other end of the conveyer.

The device to control the tension applied to the conveyers is shown in FIGS. 8 and 9. For instance, both ends of the support shaft $\mathbf{12}_1$ supporting the guide roller $\mathbf{11}_1$ for the upper side conveyer, i.e. $\mathbf{12}_{1a}$ and $\mathbf{12}_{1b}$, are attached to the support plate 13 through a pair of slide bodies $\mathbf{18}_{1a}$ and $\mathbf{18}_{1b}$, and the slide bodies $\mathbf{18}_{1a}$ and $\mathbf{18}_{1b}$ are freely slidable with the aid of two pairs of rails $\mathbf{19}_{1a}$ and $\mathbf{19}_{1b}$, which are spaced vertically apart with the slide bodies $\mathbf{18}_{1a}$ and $\mathbf{18}_{1b}$ therebetween, in the moving direction of the conveyer by rotating the handle 20 so as to control the tension of the upper side conveyer 2. The construction of the device to control the tension of the lower side conveyer 2' is the same as above mentioned.

In FIG. 7, a drive chain 21 rotates the guide rollers $\mathbf{11}_1$, $\mathbf{11}_2$ and $\mathbf{11}_1'$, $\mathbf{11}_2'$ at a constant speed, and control rollers 22 control the tension of the drive chain 21.

Since the guide rollers $\mathbf{11}_1$ and $\mathbf{11}_2$ which support the upper side conveyer 2 at both ends thereof, are supported by the support plate 13 which is movable up and down by operating the handles $\mathbf{17}_1$ and $\mathbf{17}_2$ (not shown in the figures), the upper side conveyer can be moved up and down. On the other hand, the lower side conveyer 2' is placed at a constant level. Therefore, the gap, a, between the two conveyers or the width of the cloth passage can freely be controlled. Since the upper jet pipes 3 are attached to the support plate 13, the distance from the lower jet pipes 3' can also be controlled simultaneously. Furthermore, the vertical shafts $14_{1a}$ and $14_{1b}$ supporting the guide roller $11_1$ at one end of the conveyer and the shafts $14_{2a}$ and $14_{2b}$ supporting the guide roller $11_2$ at the other end of the conveyer can be operated independently, so that the width of the gap, a, between the two conveyers and accordingly the distance between the two sets of jet pipes up and down can be changed along the cloth passage, for instance, further apart in the vicinity of the cloth inlet and closer together in the vicinity of the cloth outlet, to meet with the treatment requirements. Thus, this example is very suitable to carry out the untwisting and crimping of different kinds of cloth by using a single apparatus.

Another merit of this example is that the tension applied to the endless net conveyers 2 and 2' can conveniently be controlled by operating the handles 20 and 20' to render the process smooth. Moreover, since the two conveyers 2 and 2' are rotated by means of a common drive chain 21 to which a motor (not shown in the figures) is attached, the two conveyers rotate at the same speed, and since control rollers 22 are attached to the drive chain 21, the speed of the two conveyers can be controlled constant.

EXAMPLE 5

In passing a cloth through the cloth passage in a snaky or undulating state by jetting a high pressure fluid against the cloth in the present inventive apparatus, the cloth floats up and shifts irregularly in the crosswise direction occasionally at the neighborhood of the inlet and outlet inside of the treating chamber, particularly when the first member of the jet pipe is positioned at the lower side of the cloth passage, preventing the smooth operation. This example offers a device to eliminate such a drawback.

Figure 10:
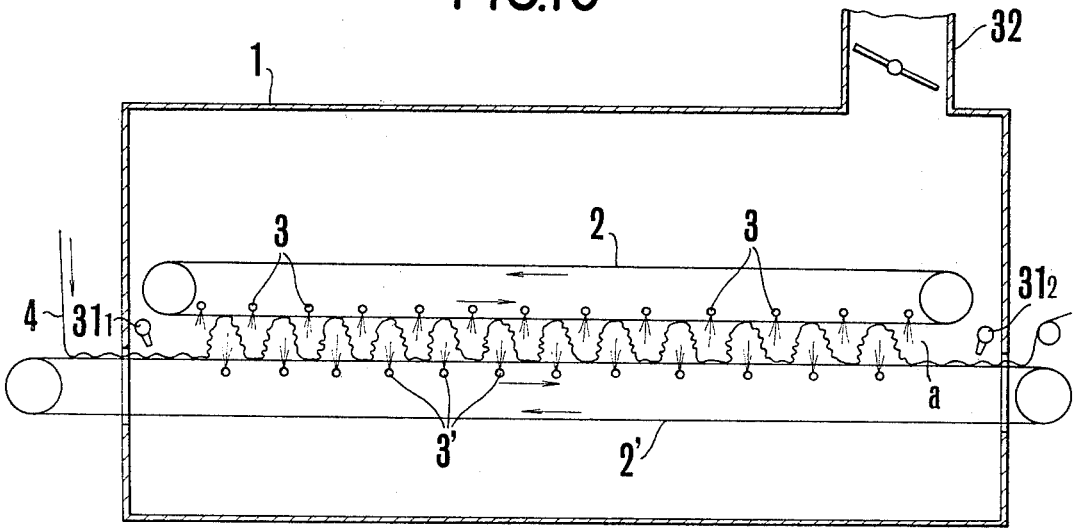
FIG. 10 is a schematic side view of another apparatus embodying the present invention.
Figure 11:
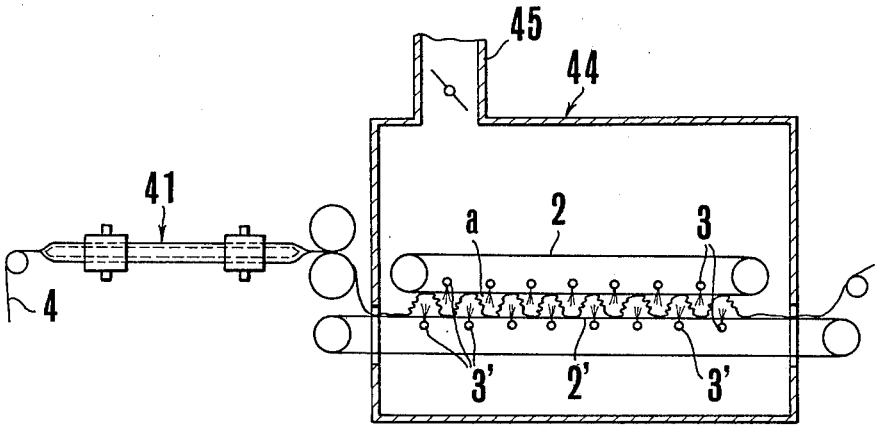
FIG. 11 is a schematic side view of another apparatus and including expanding means and setting means.
Figure 12:
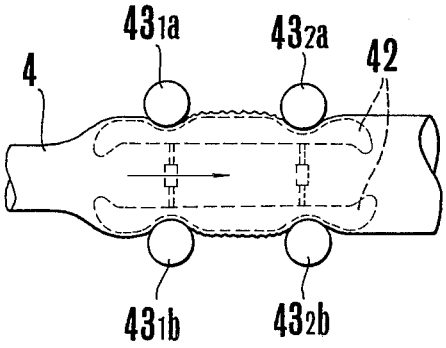
FIG. 12 is an enlarged view of a part of the expanding means in FIG. 11.

In FIG. 10, a number of control nozzles $31_1$ are provided in the cloth passage crosswise thereto adjacent the cloth inlet inside of the treating chamber 1, and a number of control nozzles $31_2$ are provided similarly adjacent to the cloth outlet.

By jetting a high pressure fluid against the cloth using control nozzles $31_1$ and $31_2$, the cloth is pushed against the lower conveyer at the inlet and outlet parts of the treating chamber, so that the cloth assumes a snaky shape in a smooth manner as it passes through the cloth passage with no floating up and irregular movement. Since the fluid pushes the cloth to the lower side conveyer, the use of air is desirable. In this connection, a fan 32 is provided to exhaust the air supplied. This device can conveniently be applied to the apparatuses in Examples 1, 2 and 3.

EXAMPLE 6

A long cylindrical cloth knitted by a knitting machine is frequently irregular in its width, and particularly when a cylindrical cloth is subjected to untwisting and crimping, for instance, by using the present inventive apparatus, the irregularity of the cloth in its width becomes more distinct. Therefore, it is advisable to expand and set the cylindrical cloth after untwisting and crimping. This example comprises an apparatus for continuous untwisting and crimping of a long cloth to which expanding and setting means for a long cylindrical cloth are annexed.

The cloth expanding means 41 comprises a cloth expanding frame 42 located inside a cylindrical cloth to be treated, and two pairs of guide rollers $43_{1a}$, $43_{1b}$ and $43_{2a}$, $43_{2b}$ provided in a rectangular arrangement outside the cylindrical cloth and in contact therewith. The two pairs of guide rollers are rotated in synchronization with one another. The widths of the cloth expanding frame 42 as well as the distance between one set of guide rollers, $43_{1a}$ and $43_{2a}$, and the other set thereof, $43_{1b}$ and $43_{2b}$, can be controlled suitably for applying the means to various kinds of cloth of different width. Other types of the cloth expanding means can also be applicable.

The construction of the cloth setting means 44 is similar to that of the apparatus for untwisting and crimping a cloth in Example 1. Air is to be jetted through the jet pipes 3 and 3', preferably at lower temperatures, and accordingly a fan 45 is provided to exhaust the air supplied.

In subjecting an untwisted and crimped cylindrical cloth to expansion, it is preferable to untwist and crimp the cloth with the use of steam or water, desirably at higher temperatures, so that the cloth absorbs 30 to 40% of humidity. The cloth is then passed through the expanding means 41. By rotating the guide rollers $43_{1a}$, $43_{2a}$ and $43_{1b}$, $43_{2b}$ at a constant speed, the cloth is constantly expanded to a prescribed width and enters into the setting means 44. In the setting means 44, the cloth continuously receives a jetting force of air zigzag from both sides and adopts a snaky state. Thus, the cylindrical cloth can continuously and effectively be set with a constant width under no tension without missing the feeling and bulkiness of the product.

As above described, the present inventive apparatus for continuous untwisting and crimping of a long cloth is characterized by providing a pair of vertically spaced endless net conveyers forming a gap therebetween to serve as a cloth passage, and a plurality of jet pipes, each of which is fitted with a series of nozzles for jetting a high pressure fluid into the cloth passage, in a zigzag, up and down manner from both sides of the gap with the conveyers between the nozzles. In continuously passing a cloth through the cloth passage while receiving the jetting force of a fluid zigzag from both sides thereof, the cloth, travels in a snaky state, is stretched, beat and crumpled strongly, so that it is untwisted and crimped effectively. While the apparatus is arranged in a horizontal direction in the examples, similar effect can be obtained in arranging the apparatus in a vertical direction.

What we claim is:

1. An apparatus for continuously untwisting and crimping of a cloth, comprising a treating chamber, a pair of endless net conveyers located in said treating chamber one positioned above the other forming a gap therebetween to serve as a cloth passage, a plurality of jet pipes each having a series of nozzles for jetting a high pressure fluid into the cloth passage, with said jet pipes arranged in a zigzag manner up and down on both outer sides of the gap within said net conveyers so that said nozzles direct the jets of high pressure fluid through said net conveyers into the gap, a support plate for each of said endless net conveyers, said jet pipes supported on said support plates supporting said endless net conveyers within which said jet pipes are arranged, means for moving at least one of said support plates toward and away from the other with the opposite ends of the support plate being movable independently of one another for varying the gap between said endless net conveyers and between said jet pipes so that the gap between said endless net conveyers can be uniform for the length thereof and so the gap can be of a variable dimension along the length, a pair of guide rollers located at the opposite ends of each said endless conveyers and said guide rollers supported on said support plate which supports said endless conveyer at the opposite ends of which said guide rollers are located, and second means mounted on said support plates for supporting each said pair of guide rollers for controlling the tension applied to said endless conveyers.

2. An apparatus for continuously untwisting and crimping of a cloth as set forth in claim 1, wherein the plurality of said jet pipes are divided into two groups with said jet pipes in each said group located above and below the gap formed by said conveyers, said jet pipes in each said groups are disposed in parallel, one said group having said jet pipes extending approximately perpendicularly to said net conveyers and the other said group having said jet pipes extending obliquely to said net conveyers, and said two groups alternating with one another along the length of said net conveyers.

* * * * *